United States Patent [19]

Imber

[11] 4,202,462

[45] May 13, 1980

[54] CONTAINERS HAVING LOCKING STRUCTURE

[75] Inventor: William I. Imber, St. Albans, England

[73] Assignee: Metal Box Limited, Reading, England

[21] Appl. No.: 3,937

[22] Filed: Jan. 16, 1979

[30] Foreign Application Priority Data

Feb. 1, 1978 [GB] United Kingdom ..... 4071/78

[51] Int. Cl.[2] ..... B65D 41/00; B65D 41/04

[52] U.S. Cl. ..... 220/293; 215/337; 220/295

[58] Field of Search ..... 220/293, 295, 296, 298; 215/337

[56] References Cited

U.S. PATENT DOCUMENTS 2,849,146 8/1958 Wigert ..... 220/296

*Primary Examiner*—George T. Hall

*Attorney, Agent, or Firm*—Diller, Ramik & Wight

[57] ABSTRACT

A container comprising a metal container body having an access aperture with a curled rim and a cap for closing the access aperture with the latter carrying a plurality of radially projecting projections and the curled rim of the container body having recesses therein, portions of the curled rim being radially flattened to provide the recesses and leave adjacent thereto rim portions under which the projections of the cap can engage, the recesses being arranged to permit passage of the cap projections therethrough upon bringing the cap axially up to the access aperture, and the cap projections being arranged to engage under the rim portions adjacent the recesses when the cap is then turned, so as to secure the cap on the container body.

7 Claims, 7 Drawing Figures

CONTAINERS HAVING LOCKING STRUCTURE

FIELD OF THE INVENTION

This invention relates to containers and in particular to containers having a metal container body, such as cans in which food stuffs and other products are commonly packaged.

BACKGROUND OF THE INVENTION

In many cases it is desirable for containers to be easily recloseable. The most desirable type of reclosure, so far as the user is concerned, is one which can be placed over the access aperture of the container and turned to effect reclosure, for example a screw cap of which many kinds are available. However, it has been necessary, in order to satisfactorily apply a screw-type reclosure to a metal container body, to form some kind of screw thread around the upper part of the container body wall. In production, this is a relatively slow process and adds significantly to the cost of the container. Also, if it is desired to have a printed or other decorative finish extending right to the top of the container, the screw threading operation has to be carried out in an area where the finish has already been applied and consequently the finish is readily damaged.

Further, many products including food stuffs require to be packed in metal containers which are hermetically sealed yet easy to open. This has been done in recent years using the well-known ring-pull closure, a ring of which is pulled in order to tear away a part of the hermetically sealed lid of the container. This type of closure is destroyed on opening and therefore requires an additional re-closure after the lid has been broken open.

SUMMARY OF THE INVENTION

The present invention provides a container comprising a metal container body having an access aperture with a curled rim, and a cap for closing the access aperture, said rim and the cap being provided with formations which are inter-engageable by a turning movement of the cap, to secure the cap on the container body.

The invention thereby provides a particularly economical form of screw closure, because it avoids the necessity for the relatively expensive operation of threading the wall of the container body and also enables the use of a can which has a very short skirt and therefore requires less material then the relatively long-skirted caps usually employed as a screw closure.

Also, because the invention involves formations only on the curled rim of the container and not on its wall, the possibility of damaging a finish applied to the can wall is substantially avoided.

In addition, the invention can be applied to the type of can body disclosed in our pending British Patent Application No. 43522/77 (which is hereby incorporated herein by reference), this combination providing not only a hermetic seal and easy opening facilities, but also easy and effective reclosure of the container after the hermetic seal has been broken.

The invention also enables the provision of a shallow flush fitting lid on a metal container body. The lid depth may be greater than that shown in the embodiments to be described, as desired, with the depth of the necked body portion correspondingly increased.

BRIEF DESCRIPTION OF THE DRAWINGS

In order that the invention may be more clearly understood, two embodiments thereof will now be described, by way of example, with reference to the accompanying diagrammatic drawings, in which.

DETAILED DESCRIPTION OF EMBODIMENTS

Figure 1:
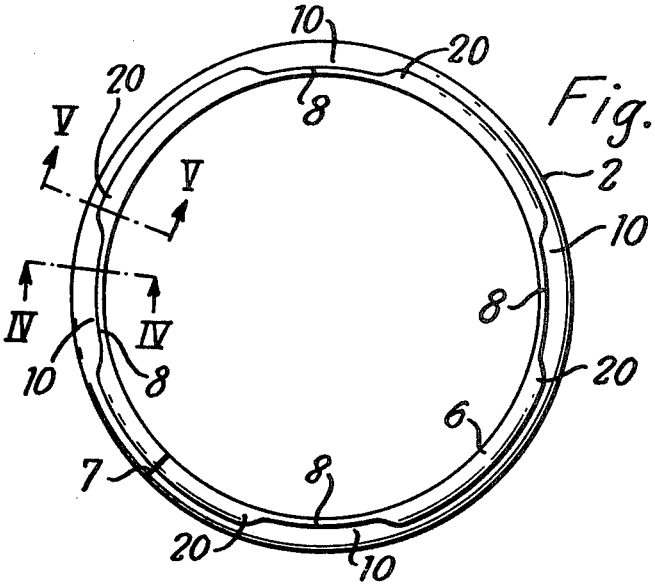
FIG. 1 shows a top plan view of a container according to the invention.
Figure 3:
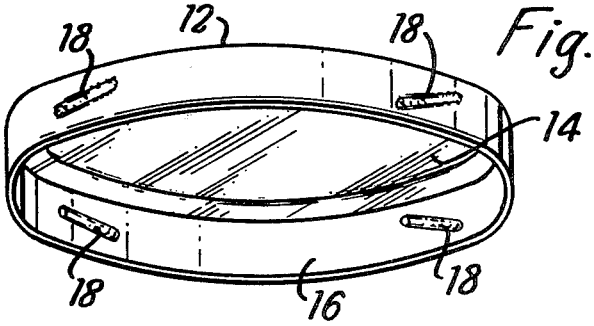
FIG. 3 shows a cap for the container of FIGS. 1 and 2.
Figure 2:
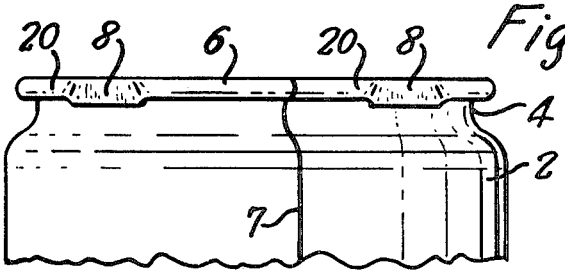
FIG. 2 shows a side elevation of the upper part of the container of FIG. 1.

Referring to FIGS. 1 to 3, a container comprises a container body 2 which is necked at 4 just below a curled rim 6, which extends around the access aperture of the container. The container body can be of any construction capable of having a curled rim, for example it may be a built-up body having a side seam 7 which is a lap welded seam, or a lock seam, or a "mash" welded side seam, the latter form of construction as disclosed in the above mentioned application being preferred; the container body may alternatively be a drawn metal body. If the body is a built-up type, then it may, if desired, be made from double reduced (DR) tin plate; however other tin plates or aluminium sheet may be used.

The curled rim 6 is flattened in the radial direction at four positions equally spaced round its periphery. The flattened portions are indicated at 8 and result in recesses 10 lying between the flattened portions.

A cap 12 is shown in FIG. 3. The cap may be of drawn metal or of plastics material. It is illustrated as being of drawn metal and having a top 14 and a skirt 16, the skirt being formed with four equally spaced radially inwardly projecting projections 18 formed by indenting the metal from the outside. The projections 18 are slightly angled as shown and are slightly shorter in length than are the recesses 8 so that as the cap 12 is placed on the container body 2 the projections 18 can pass axially through the recesses 10. By then turning the cap 12 clockwise relative to the container body the projections 18 engage under the rim portions 20 located immediately clockwise adjacent the recesses 10 and the slight angling of the projections 18 causes slight further turning to draw the cap 12 down tightly over the container aperture.

Figure 4:
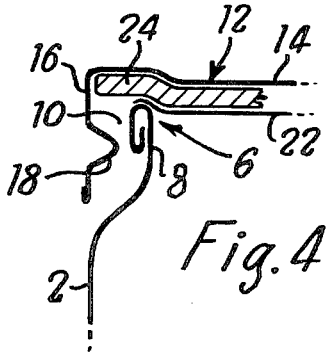
FIGS. 4 and 5 show local cross-sections on lines IV—IV and V—V, respectively, of FIG. 1.
Figure 5:
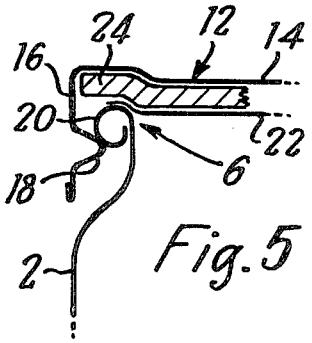

FIG. 4 shows how a projection 18 can pass down through recess 10 formed by the flattened curled rim portion 8 and FIG. 5 shows how the projection 18 comes into contact with the adjacent rounded portion 20 of the curled rim when the cap 12 is turned.

FIGS. 4 and 5 also show how the container body 2 may be sealed by means of a diaphragm 22 bonded around the top of the curled rim 6. These Figures also show a wad 24 of packing material which may be employed to ensure that the diaphragm edge is held firmly in contact with the rim while the bond is setting after the cap 12 has been applied. If the diaphragm 22 is intended to achieve a hermetic seal, then preferably the container body 2 will either be drawn and consequently seamless, or will be a seamed body constructed as described in the application referred to above. It will be appreciated that the top of curled rim 6 is narrower at the flattened portions 8 than elsewhere so that the bonding area is reduced. To assist in achieving a good bond in these narrow regions, the centre of the cap 12 may be slightly indented as shown in FIGS. 4 and 5 so that it causes the diaphragm 22 to be pressed slightly into the mouth of the container body 2 and consequently "wraps" the margin of the diaphragm slightly around the inner surface of the curled rim, rather than pressing it simply against the top of the curled rim.

It is to be noted that the cap 12 has a diameter substantially equal to the maximum diameter of the can body 2 so that once it is fitted the cap skirt 16 is flush with the main side wall of the can, thus giving a pleasant appearance and helping to avoid damaging of the cap skirt during handling.

Figure 6:
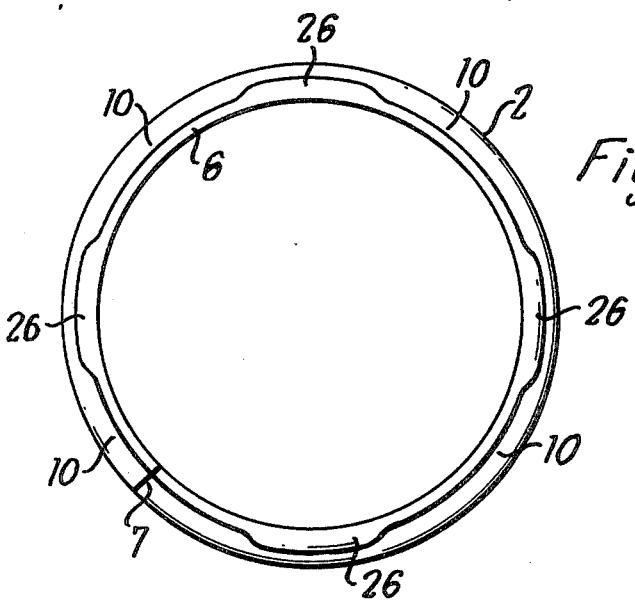
FIG. 6 shows a top plan view of a different form of container in accordance with the invention.
Figure 7:
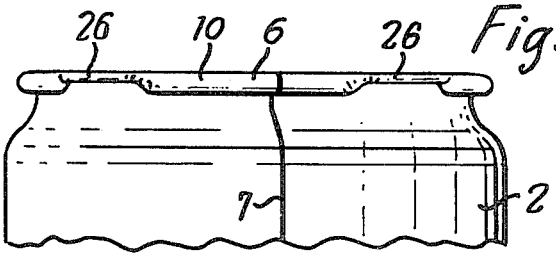
FIG. 7 is a side elevation of the container of FIG. 6.

In FIGS. 6 and 7 parts equivalent to parts in the preceding Figures are given the same reference numerals. In the embodiments shown in FIGS. 6 and 7 the recesses 10 outside the curled rim 6 are formed in a different manner. Instead of the curled rim being flattened radially to make recesses where it is flattened, it is flattened axially at four equally spaced positions, the flattened portions 26 thereby spreading radially outwardly, similar to portions of a flange. Consequently, the recesses 10 lie between the flattened rim portions instead of in register with them and it is radially projecting rim portions 26, under which the inward projections 18 on the lid are able to engage so as to permit the cap 12 to be secured on the container body 2 by putting the cap on the container body, the cap projections 18 passing down through the recesses 10, and then turning the cap so that projections 18 engage under the adjacent parts of flattened portions 26. Instead of the projections 18 on the cap 12 being slightly angled, the outer edges of the flattened rim portions 26 may be slightly angled by twisting them while flattening them.

It can be seen that the formation shown in FIGS. 6 and 7 does not involve narrowing the top of the curled rim 6, so that the bonding area is not reduced as it was in the previous embodiment.

It had hitherto been somewhat difficult to reliably provide an external thread on a body of a container made from double-reduced (DR) tin plate because that material is brittle and particularly inclined to fracture when stretched, and the provision of a thread involved stretching the metal and consequently the possibility of fracturing it. It can therefore be appreciated that the present invention, apart from its other advantages, enables provision of a screw-type closure on a DR plate container without the likelihood of damaging the container body while forming a thread on it.

Whilst the invention has been described in terms of a container having four flattened portions and a cap having four projections, it will be understood that the value of having a plurality of such engaging means resides in the even clamping of cap to body around the rim. Therefore any number of engagements may be used, more than four if desired, or possibly less than four if the application will permit.

I claim:

1. A container comprising a metal container body having an access aperture with a curled rim and a cap for closing the access aperture, the cap being formed with a plurality of projections projecting radially and the curled rim of the container body having recesses therein, wherein portions of the curled rim are radially flattened so as to provide said recesses and to leave, adjacent said recesses, rim portions under which the projections on the cap can engage, the recesses being arranged to permit passage of the cap projections therethrough upon bringing the cap axially up to the access aperture, and the cap projections being arranged to engage under said rim portions adjacent the recesses when the cap is then turned, so as to secure the cap on the container body.

2. A container as claimed in claim 1 wherein the container body is a built-up body having a mash welded side seam.

3. A container as claimed in claim 1 wherein the container body is necked whereby the rim is of less diameter than a main part of the container body, and the cap has a skirt of an outside diameter substantially the same as that of the main part of the container body so as to be flush fitting.

4. A container as claimed in claim 1 wherein the projections on the cap are substantially shorter in the peripheral direction than the spaces between them.

5. A container as claimed in claim 1 wherein the recesses in the container body rim are substantially shorter in the peripheral direction than the spaces between them.

6. A container as claimed in claim 1 wherein a closure diaphragm is bonded to the curled rim.

7. A container as claimd in claim 1 wherein said projections project radially inwardly and the outside of said container body curled rim has said recesses therein.

* * * * *